US006076227A

United States Patent [19]

Schallig et al.

[11] Patent Number: 6,076,227

[45] Date of Patent: Jun. 20, 2000

[54] ELECTRICAL SURFACE TREATMENT DEVICE WITH AN ACOUSTIC SURFACE TYPE DETECTOR

[75] Inventors: Michiel A. Schallig; Albert J. Meijer; Peter S. Viet; Jan Tiesinga, all of Drachten, Netherlands

[73] Assignee: U.S. Philips Corporation, New York, N.Y.

[21] Appl. No.: 09/135,366

[22] Filed: Aug. 17, 1998

[30] Foreign Application Priority Data

Aug. 25, 1997 [EP] European Pat. Off. ..... 97202623

[51] Int. Cl.[7] ..... A47L 9/28

[52] U.S. Cl. ..... 15/319; 15/339; 73/599

[58] Field of Search ..... 15/49.1, 98, 319, 15/339; 73/599, 584, 596, 573, 627

[56] References Cited

U.S. PATENT DOCUMENTS

| | | | |
|---|---|---|---|
| 4,574,637 | 3/1986 | Adler et al. | 73/599 |
| 4,953,253 | 9/1990 | Fukuda et al. | 15/319 |
| 4,977,639 | 12/1990 | Takahashi et al. | 15/319 |
| 5,144,715 | 9/1992 | Matsuyo et al. | 15/319 |
| 5,381,584 | 1/1995 | Jyoraku et al. | 15/319 |
| 5,722,109 | 3/1998 | Delmas et al. | 15/339 |

FOREIGN PATENT DOCUMENTS

| | | | |
|---|---|---|---|
| 0372903A1 | 6/1990 | European Pat. Off. . | |
| 2-102629A | 4/1990 | Japan . | |
| 4-189334 | 7/1992 | Japan | 15/319 |

*Primary Examiner*—Theresa T. Snider
*Attorney, Agent, or Firm*—Ernestine C. Bartlett

[57] ABSTRACT

The invention relates to an electrical surface treatment device which is provided with an acoustic surface type detector with which a type of a surface to be treated can be detected during operation. According to the invention, the surface type detector delivers an output signal ($u_{FT}$) during operation which is characteristic of the type of surface to be treated and which is determined by a value of a physical quantity of air vibrations reflected by the surface to be treated, which value is measured by a vibration detector of the surface type detector. In a special embodiment, the physical quantity is an amplitude, and the surface type detector is a vibration generator for generating air vibrations having a predetermined amplitude. The generated air vibrations preferably have a frequency of at least 15,000 Hz which varies within a predetermined range. In a further embodiment, the vibration generator generates the air vibrations intermittently, and the surface type detector is a parallel circuit through which a portion of the generated air vibrations can be directly guided to the vibration detector.

16 Claims, 5 Drawing Sheets

ELECTRICAL SURFACE TREATMENT DEVICE WITH AN ACOUSTIC SURFACE TYPE DETECTOR

DESCRIPTION

The invention relates to an electrical surface treatment device provided with a surface type detector for detecting a type of surface to be treated, which surface type detector comprises a vibration detector for detecting air vibrations reflected by the surface to be treated and delivers an output signal characteristic of the type of the surface to be treated during operation.

The invention also relates to an attachment suitable for use in an electrical surface treatment device according to the invention.

BACKGROUND OF THE INVENTION

An electrical surface treatment device of the kind mentioned in the opening paragraph constructed as a vacuum cleaner and provided with an attachment of the kind mentioned in the second paragraph constructed as a suction attachment is known from EP-A-0 372 903. The surface type detector of the known vacuum cleaner is an acoustic surface type detector which is accommodated in the suction attachment of the vacuum cleaner. The vibration detector of the surface type detector forms part of an ultrasonic system by means of which a distance is measurable which is present during operation between the surface to be cleaned and a lower side of a suction nozzle of the suction attachment. If the ultrasonic system measures a comparatively great distance, the surface type detector delivers an output signal which is characteristic of a hard, smooth floor. If the surface to be cleaned is a carpet, an edge of the suction nozzle projecting beyond the lower side of the suction nozzle will sink partly into the carpet, so that the ultrasonic system will measure a comparatively small distance. In this case the surface type detector delivers an output signal which is characteristic of a carpet. The output signal of the surface type detector of the known vacuum cleaner is used for controlling an electric motor by means of which a brush arranged in the suction nozzle can be rotated and for controlling the sensitivity of an optical dust detector of the vacuum cleaner.

It is a disadvantage of the known electrical surface treatment device and the known attachment that the surface type detector used therein has only a limited distinguishing power, said surface type detector being capable of delivering substantially exclusively an output signal characteristic of a hard, smooth floor and an output signal characteristic of a carpet.

SUMMARY OF THE INVENTION

It is an object of the invention to provide an electrical surface treatment device and an attachment of the kinds mentioned in the opening paragraphs which are provided with a surface type detector having a distinguishing power which is as great as possible.

The electrical surface treatment device according to the invention is for this purpose characterized in that the output signal is determined by a value of a physical quantity of the air vibrations reflected by the surface to be treated, which value is measurable by means of the vibration detector.

The air vibrations are generated during operation by, for example, a vibration generator of the surface type detector or some other vibration source present in the electrical surface treatment device. Such air vibrations are partly absorbed by the surface to be treated, partly transmitted through the surface to be treated, and partly reflected by the surface to be treated. Said physical quantity of the air vibrations reflected by the surface to be treated accordingly has a value which differs from an original value of the physical quantity of the generated air vibrations. Since the absorption, the transmission and the reflection of the air vibrations by the surface to be treated take place in a ratio which is dependent on the type of the surface to be treated in a distinguishing manner, the value of said physical quantity of the air vibrations reflected by the surface to be treated is determined by the type of the surface to be treated in a distinguishing manner, such that the type of the surface to be treated can be derived from said output signal of the surface type detector in a distinguishing manner. It is thus possible for the surface type detector to distinguish not only a hard, smooth floor from a carpet, but also, for example, to detect the type of smooth floor and the type of carpet in a distinguishing manner when this surface type detector is used, for example, in a vacuum cleaner.

A special embodiment of an electrical surface treatment device according to the invention is characterized in that the physical quantity is an amplitude, while the surface type detector comprises a vibration generator for generating air vibrations having a predetermined amplitude. The predetermined amplitude of the air vibrations which can be generated by the vibration generator forms a reference with which the amplitude of the air vibrations reflected by the surface to be treated can be compared by the surface type detector. An accurate and reliable operation of the surface type detector is provided thereby.

A further embodiment of an electrical surface treatment device according to the invention is characterized in that the vibration generator generates air vibrations with a frequency of at least 15,000 Hz during operation. It was found that electrical surface treatment devices generate air vibrations with frequencies which in the main lie below 15,000 Hz under normal operational conditions. Since the air vibrations generated by the vibration generator have a frequency of at least 15,000 Hz, the vibration generator need not drown out the air vibrations generated by the other parts of the electrical surface treatment device, so that the amplitude of the air vibrations generated by the vibration generator can remain limited. It was further found that the distinguishing power of the surface type detector is much greater at frequencies of at least 15,000 Hz than at lower frequencies. In addition, air vibrations having frequencies of at least 15,000 Hz are hardly audible to a user of the electrical surface treatment device, or even not audible at all.

A yet further embodiment of an electrical surface treatment device according to the invention is characterized in that the vibration generator generates air vibrations having a frequency which varies within a predetermined range during operation. In this embodiment, the output signal of the surface type detector corresponds, for example, to an average amplitude or maximum amplitude of the air vibrations reflected by the surface to be treated within said range. It was found that as a result of this the output signal is dependent on parameters other than the type of the surface to be treated, such as, for example, a distance from the vibration generator and the vibration detector to the surface to be treated, the acoustic properties of the part of the electrical surface treatment device in which the vibration generator and the vibration detector are arranged, and the temperature of the vibration generator and the vibration detector, to a limited degree only.

A special embodiment of an electrical surface treatment device according to the invention is characterized in that the vibration detector comprises a piezoelectric vibration detector. Such a piezoelectric vibration detector is sufficiently robust under normal operating conditions and substantially insensitive to pollution.

A further embodiment of an electrical surface treatment device according to the invention is characterized in that the vibration generator comprises a piezoelectric vibration generator. Such a piezoelectric vibration generator is sufficiently robust under normal operating conditions and substantially insensitive to pollution.

A yet further embodiment of an electrical surface treatment device according to the invention is characterized in that the vibration generator comprises the vibration detector, such that the vibration generator can be switched over so as to form the vibration detector. The number of components of the surface type detector is considerably reduced thereby, so that the surface type detector has a simple construction. When the vibration generator is switched over so as to form the vibration detector during operation, the air vibrations generated by the vibration generator just previously and reflected by the surface to be treated can be detected by the vibration generator.

A particular embodiment of an electrical surface treatment device according to the invention is characterized in that the vibration generator and the vibration detector face one another at an angle of approximately 90°. It was found that a very reliable operation of the surface type detector is obtained with such a mutual arrangement of the vibration generator and the vibration detector.

A further embodiment of an electrical surface treatment device according to the invention is characterized in that the surface type detector is provided with a first reflector for reflecting the air vibrations generated by the vibration generator towards the surface to be treated, and with a second reflector for reflecting the air vibrations reflected by the surface to be treated towards the vibration detector. The use of said reflectors provides a great freedom as regards the mutual arrangement of the vibration generator and the vibration detector. The vibration generator and the vibration detector in this embodiment may be positioned, for example, immediately next to one another.

A yet further embodiment of an electrical surface treatment device according to the invention is characterized in that the vibration generator generates the air vibrations intermittently during operation. In this embodiment, the vibration generator generates the air vibrations during a time period each time which is so short that interferences between the generated and the reflected air vibrations are prevented as much as possible during operation. Such interferences, which arise when the vibration generator generates air vibrations without interruptions, have a pattern which changes comparatively strongly with comparatively small changes in the acoustic properties of the surface type detector and the surface to be treated. In addition, major differences in the amplitude of the air vibrations occur within said pattern. Said interferences thus have a considerable negative influence on the accuracy and the reliability of the surface type detector. The accuracy and reliability of the surface type detector are considerably improved in that such interferences are prevented by the intermittent generation of the air vibrations by the vibration generator. Since the vibration generator in this embodiment generates air vibrations during a comparatively short period each time, the vibration generator can be used as a vibration detector during the remaining time, provided the vibration generator is one which can be switched over to a vibration detector function.

A special embodiment of an electrical surface treatment device according to the invention is characterized in that the surface type detector comprises a parallel circuit through which part of the air vibrations generated by the vibration generator can be conducted directly to the vibration detector. The properties of the vibration generator and the vibration detector may change because of aging and temperature fluctuations. The portion of the intermittently generated air vibrations which is conducted through the parallel circuit during operation and the portion of the intermittently generated air vibrations which is conducted via the surface to be treated during operation reach the vibration detector at different moments. This renders it possible for the vibration detector to measure a ratio between the amplitude of the air vibrations reflected by the surface to be treated and the original amplitude of the generated air vibrations. Said ratio is substantially independent of the temperature and of any aging of the vibration generator and the vibration detector. The air vibrations conducted through the parallel circuit thus serve as a reference with which the amplitude of the air vibrations reflected by the surface to be treated can be compared by the surface type detector.

A further embodiment of an electrical surface treatment device according to the invention is characterized in that the parallel circuit has a dead end and is provided near this end with an end reflector for reflecting back the air vibrations conducted into the parallel circuit. A vibration generator is used in this embodiment which generates the air vibrations intermittently and which is also switchable so as to form the vibration detector. The portion of the air vibrations conducted through the parallel circuit during operation is reflected by the end reflector back into the parallel circuit and reaches the vibration generator, which has now been switched to a vibration detector, so as to form a reference. A particularly simple and practical construction of the surface type detector is provided in this manner.

An attachment according to the invention which is suitable for use in an electrical surface treatment device according to the invention is characterized in that the surface type detector is accommodated in a suction nozzle of the attachment. Since the surface type detector is accommodated in the suction nozzle of the attachment, the surface type detector is in the immediate vicinity of the surface to be treated, so that a reliable operation of the surface type detector is achieved.

An attachment according to the invention which is suitable for use in an electrical surface treatment device according to the invention, wherein the surface type detector used comprises a vibration generator for generating air vibrations having a predetermined amplitude, is characterized in that the vibration generator and the vibration detector of the surface type detector are positioned in a detection space which during operation is bounded by the surface to be treated and a lower side of a suction nozzle of the attachment. Since the vibration generator and the vibration detector are positioned in said detection space, the vibration generator and the vibration detector are in the immediate vicinity of the surface to be treated, so that a reliable operation of the surface type detector is achieved. The acoustic properties of said detection space are strongly influenced by the type of the surface to be treated during operation, so that the surface type detector will have a strong distinguishing power.

A special embodiment of an attachment according to the invention is characterized in that the vibration generator and the vibration detector are positioned in a depression provided in the lower side of the suction nozzle. The use of said depression enlarges the detection space of the surface type detector, whereby the acoustic properties of the detection space are influenced. The acoustic properties of the surface type detector are optimized in that said depression is given a suitable shape.

A further embodiment of an attachment according to the invention is characterized in that the vibration generator and the vibration detector are each accommodated in a separate channel-type cavity provided in the lower side of the suction nozzle. The use of said separate channel-type cavities achieves that the air vibrations generated by the vibration generator during operation are substantially completely reflected by the surface to be treated, so that a direct crosstalk from the vibration generator to the vibration detector is prevented as much as possible.

BRIEF DESCRIPTION OF THE DRAWINGS

The invention will now be explained in more detail below with reference to the drawing, in which FIG. 1 diagrammatically shows an electrical surface treatment device according to the invention, FIG. 2 diagrammatically shows a suction nozzle of an attachment according to the invention used in the electrical surface treatment device of FIG. 1, and FIGS. 3 to 8 diagrammatically show a first, second, third, fourth, fifth, and sixth embodiment, respectively, of a surface type detector used in the attachment of FIG. 2

DESCRIPTION OF THE PREFERRED EMBODIMENTS

Figure 1:
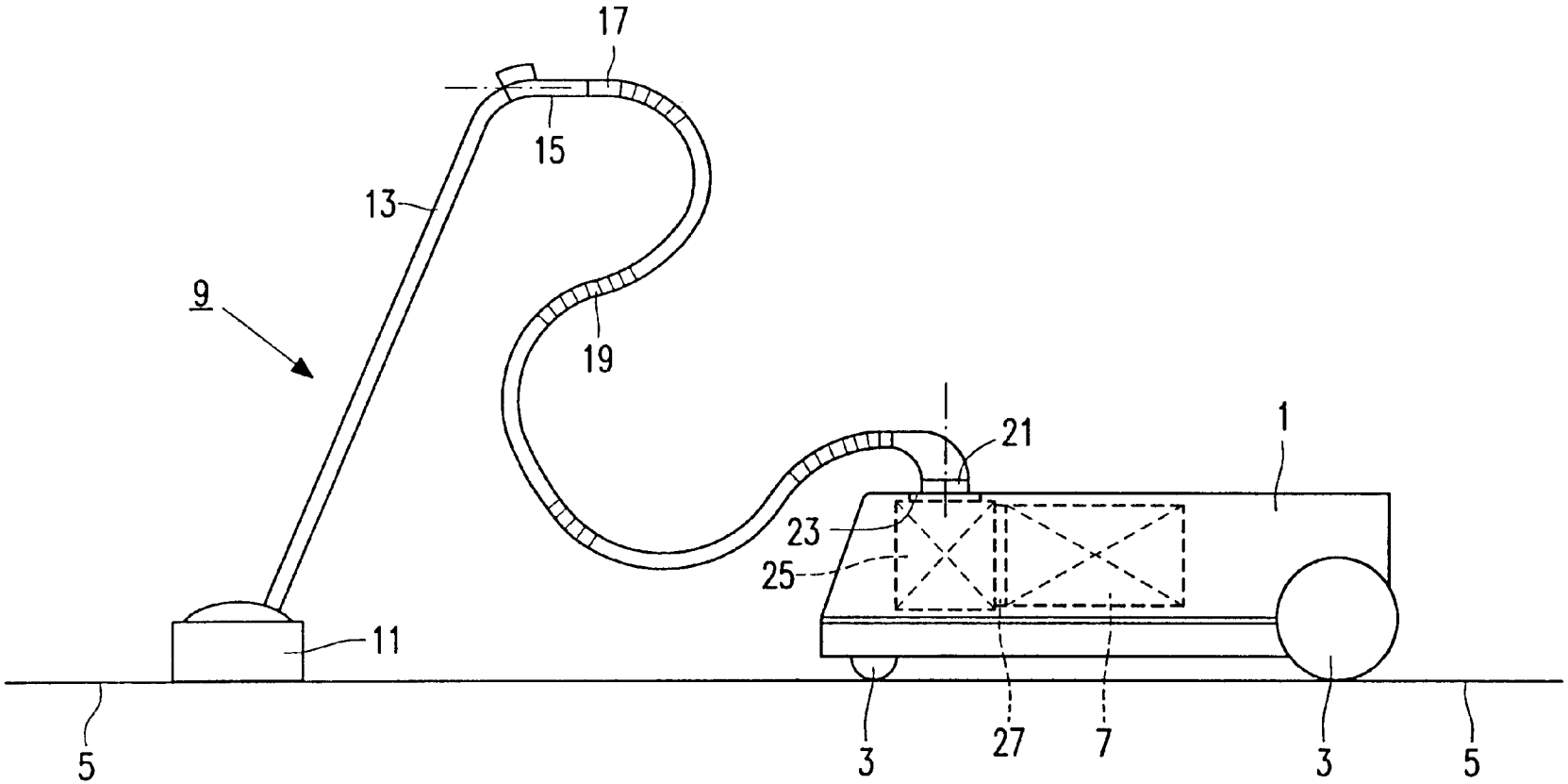

The electrical surface treatment device according to the invention shown in FIG. 1 is a vacuum cleaner for cleaning a surface. The vacuum cleaner shown is a so-called floor-type vacuum cleaner, comprising a housing 1 which is displaceable over a surface 5 to be cleaned by means of a number of wheels 3. An electrical suction unit 7 is arranged in the housing 1 and is shown diagrammatically only in FIG. 1. The vacuum cleaner further comprises an attachment according to the invention, constructed as a suction attachment 9, which comprises a suction nozzle 11, a hollow tube 13, and a handle 15. The handle 15 is detachably coupled to a flexible hose 19 by means of a first coupling 17, while the flexible hose 19 is detachably coupled to a suction opening 23 provided in the housing 1 by means of a second coupling 21. The suction opening 23 issues into a dust chamber 25 of the housing 1 which is connected via a filter 27 to the suction unit 7. During operation, an underpressure is generated by the suction unit 7 in a suction channel which comprises the suction nozzle 11, the hollow tube 13, the flexible hose 19, the suction opening 23, and the dust chamber 25 of the vacuum cleaner. Dust and dirt particles present on the surface 5 to be cleaned are discharged to the dust chamber 25 via the suction attachment 9 and the flexible hose 19 under the influence of said underpressure.

Figure 2:
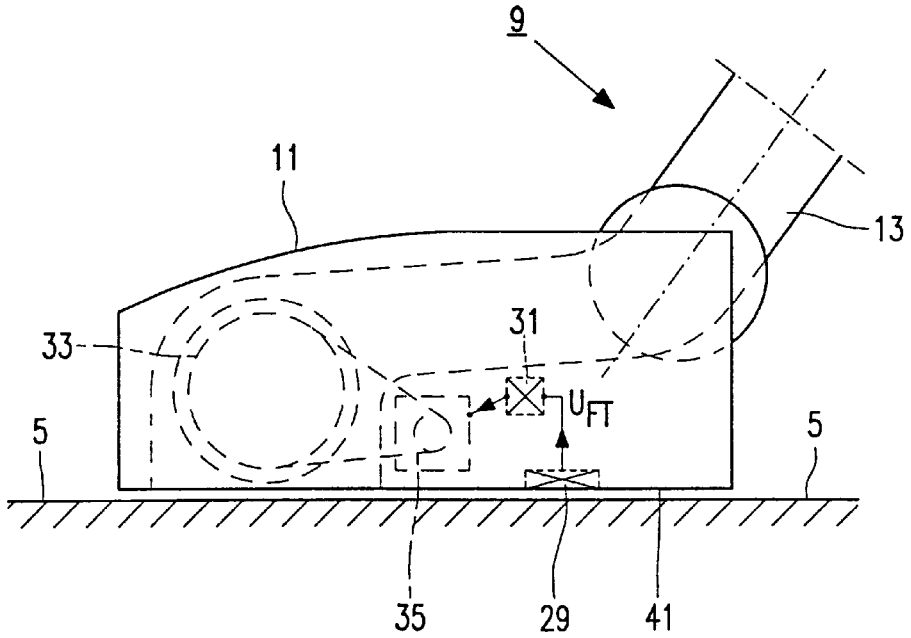

As FIG. 2 shows, the suction nozzle 11 of the suction attachment 9 comprises a surface type detector 29 for detecting a type of the surface 5 to be cleaned. The surface type detector 29, which is indicated diagrammatically only in FIG. 2 and which will be described in more detail further below, delivers an output signal $u_{FT}$ characteristic of the type of surface to be cleaned during operation to an electrical controller 31 which is also positioned in the suction nozzle 11. The suction nozzle 11 is further provided with a rotatable brush 33 which can be driven by an electric motor 35. The controller 31 controls a speed of the electric motor 35 and of the brush 33 as a function of the output signal $U_{FT}$ during operation. The speed of the brush 33 is thus adaptable to the type of the surface 5 to be cleaned, to the effect that the vacuum cleaner has an improved cleaning action. It is noted that the operation of the vacuum cleaner may also be controlled in a different manner by means of the output signal $u_{FT}$ of the surface type detector 29. Thus, for example, the vacuum cleaner may be provided with a controller accommodated in the housing 1 by means of which a suction power of the suction unit 7 is controllable as a function of the output signal $u_{FT}$.

Figure 3:
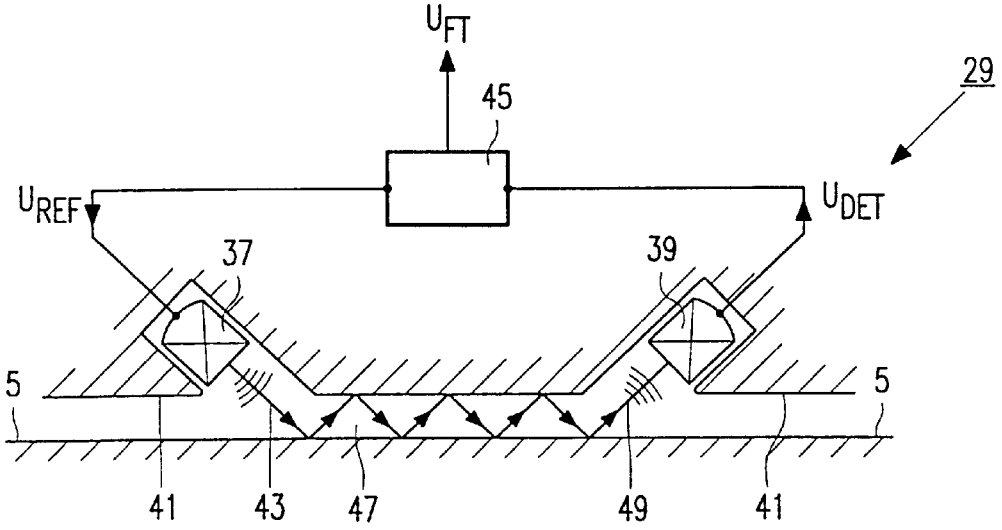

The first embodiment of the surface type detector 29 diagrammatically shown in FIG. 3 comprises a piezoelectric vibration generator 37 which is usual and known per se and a piezoelectric vibration detector 39 which is usual and known per se. The vibration generator 37 and the vibration detector 39 are provided in a lower side 41 of the suction nozzle 11, such that the vibration generator 37 and the vibration detector 39 face one another at an angle of approximately 90°. During operation, the vibration generator 37 generates air vibrations 43 which have a predetermined, substantially constant amplitude. The surface type detector 29 for this purpose comprises an electrical control member 45 which supplies an output signal $u_{REF}$ corresponding to the predetermined amplitude to the vibration generator 37 during operation. The lower side 41 of the suction nozzle 11 bounds a detection space 47 which is further bounded during operation by the surface 5 to be cleaned. The vibration generator 37 faces the detection space 47, so that the air vibrations 43 generated by the vibration generator 37 during operation propagate themselves in the detection space 47. As FIG. 3 shows, the air vibrations 43 are reflected in the detection space 47 by the surface 5 to be cleaned and the lower side 41 of the suction nozzle 11, and the reflected air vibrations 49 are detected by means of the vibration detector 39, which delivers an output signal $u_{DET}$ which corresponds to an amplitude of the reflected air vibrations 49. The air vibrations 43 generated by the vibration generator 37 are partly absorbed by the surface 5 to be cleaned and partly transmitted through the surface 5 to be cleaned to a base surface present below the surface 5 to be cleaned. As a result, the air vibrations 43 are only partly reflected by the surface 5 to be cleaned, so that the amplitude of the reflected air vibrations 49 measured by the vibration detector 39 is considerably smaller than the original, predetermined amplitude of the air vibrations 43 generated by the vibration generator 37. A ratio in which the generated air vibrations 43 are absorbed, transmitted, and reflected by the surface 5 to be cleaned is strongly dependent on the type of the surface 5 to be cleaned, so that the amplitude of the reflected air vibrations 49 is also strongly dependent on the type of the surface 5 to be cleaned. A number of experimentally ascertained values of the amplitude of the reflected air vibrations 49 which arise when the vibration generator 37 generates air vibrations having said predetermined amplitude are stored in the electrical control member 45 for a number of different types of surfaces 5 to be cleaned. Said predetermined amplitude thus forms a reference in relation to which the amplitudes of the air vibrations 49 reflected by the different types of surfaces 5 to be cleaned are distinguished. The control member 45 compares the output signal $u_{DET}$ with said stored values during operation, and determines from this comparison the instantaneous type of the surface 5 to be cleaned. Since the output signal $u_{DET}$ of the vibration detector 39 depends strongly on the type of surface 5 to be cleaned, and the output signal $u_{FT}$ of the surface type detector 29 is thus determined by means of the output signal $u_{DET}$, the surface type detector 29 has a strong distinguishing power, such that it is possible by means of the surface type detector 29 not only to distinguish between a hard, smooth floor and a carpet, but also, for example, between various types of smooth floors, such as stone floors and wooden floors, and between different kinds of carpet, as well as tatami. A reliable operation of the surface type detector 29 is achieved because the vibration generator 37 and the vibration detector 39 are arranged in the detection space 47 of the suction nozzle 11 described above and are accordingly in the immediate vicinity of the surface 5 to be cleaned.

The air vibrations 43 generated preferably have a frequency of at least 15,000 Hz, for example, approximately 40,000 Hz. Air vibrations having such a frequency cannot or substantially cannot be heard by a user of the vacuum cleaner and in addition lead to a distinguishing power which is considerably greater than at frequencies below 15,000 Hz. It was found that the usual acoustic sources present in the vacuum cleaner such as, for example, the suction unit 7, the brush 33, and the electric motor 35, generate air vibrations in the detection space 47 with frequencies below 15,000 Hz. Since the air vibrations 43 generated by the vibration generator 37 have a frequency of at least 15,000 Hz, the operation of the surface type detector 29 is substantially not affected by the air vibrations generated by the other components of the vacuum cleaner. Furthermore, it is not necessary for the vibration generator 37 to drown out the air vibrations of said other components, so that the predetermined amplitude of the air vibrations 43 generated by the vibration generator 37 can remain limited.

The air vibrations 43 generated by the vibration generator 37 have a substantially constant frequency. It was found, however, that the output signal $u_{FT}$ of the surface type detector 29 is somewhat dependent on the temperature of the vibration generator 37 and the vibration detector 39 in this case, and of the acoustic properties of the detection space 47. Said acoustic properties change, for example, because of pollution of the detection space 47 or because of changes in a distance between the lower side 41 of the suction nozzle 11 and the surface 5 to be cleaned, which changes occur mostly if the surface 5 to be cleaned is a deep-pile carpet. Such a dependence detracts from the reliability of the surface type detector 29 and can be reduced according to the invention in that the control member 45 controls the vibration generator 37 during operation such that the vibration generator 37 generates air vibrations 43 with a frequency which varies within a predetermined range such as, for example, a range from 36,000 Hz to 40,000 Hz. In such an alternative embodiment, the control member 45 determines from the output signal $u_{DET}$ of the vibration detector 39, for example, an average amplitude or maximum amplitude of the reflected air vibrations 49 within said range, and the control member 45 compares the average or maximum amplitude thus determined with experimentally ascertained average or maximum values of the amplitude of the reflected air vibrations which are stored in the control member 45 for a number of different types of surfaces 5 to be cleaned.

Figure 4:
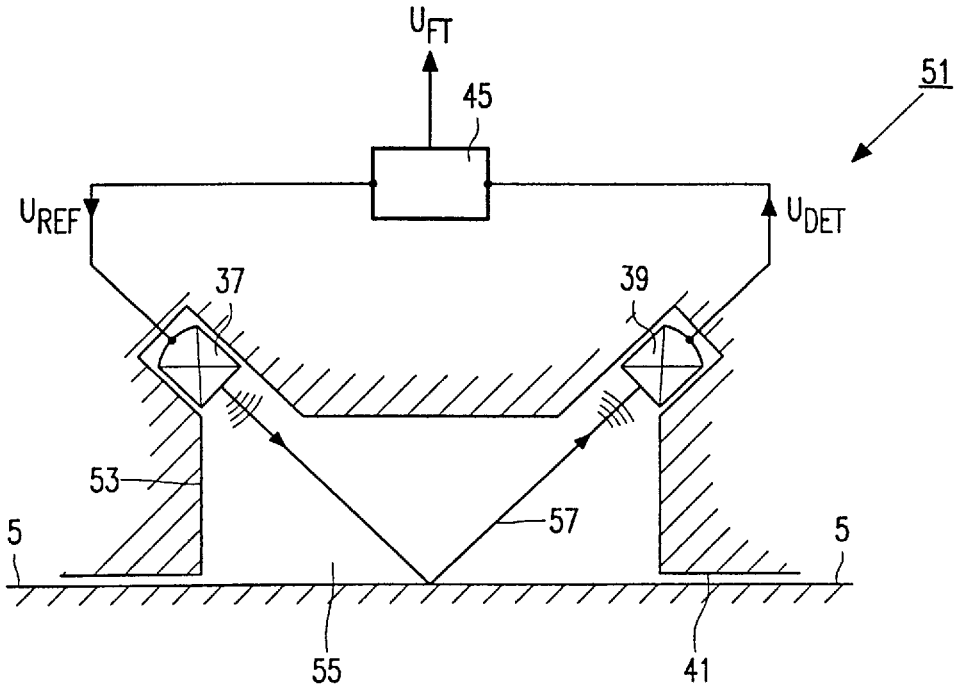

In the second, third, fourth, fifth, and sixth embodiment of a surface type detector according to the invention shown in FIGS. 4 to 8, components corresponding to components of the surface type detector 29 described above have been given the same reference numerals. In the second embodiment of a surface type detector 51 for use in the suction attachment 9 according to the invention, shown diagrammatically in FIG. 4, the vibration generator 37 and the vibration detector 39 are accommodated in a depression 53 which is provided in the lower side 41 of the suction nozzle 11. The use of the depression 53 gives the surface type detector 51 a detection space 55 which is considerably larger than the detection space 47 of the surface type detector 29 described above. As FIG. 4 diagrammatically shows, it is achieved thereby that the air vibrations 57 reaching the vibration detector 29 during operation are reflected substantially exclusively by the surface 5 to be cleaned and are substantially not reflected by the walls of the detection space 55. It is achieved thereby that the amplitude of the air vibrations 57 reaching the vibration detector 39 are influenced as little as possible by the acoustic properties of the walls of the detection space 55, whereby the reliability of the surface type detector 51 is improved.

Figure 5:
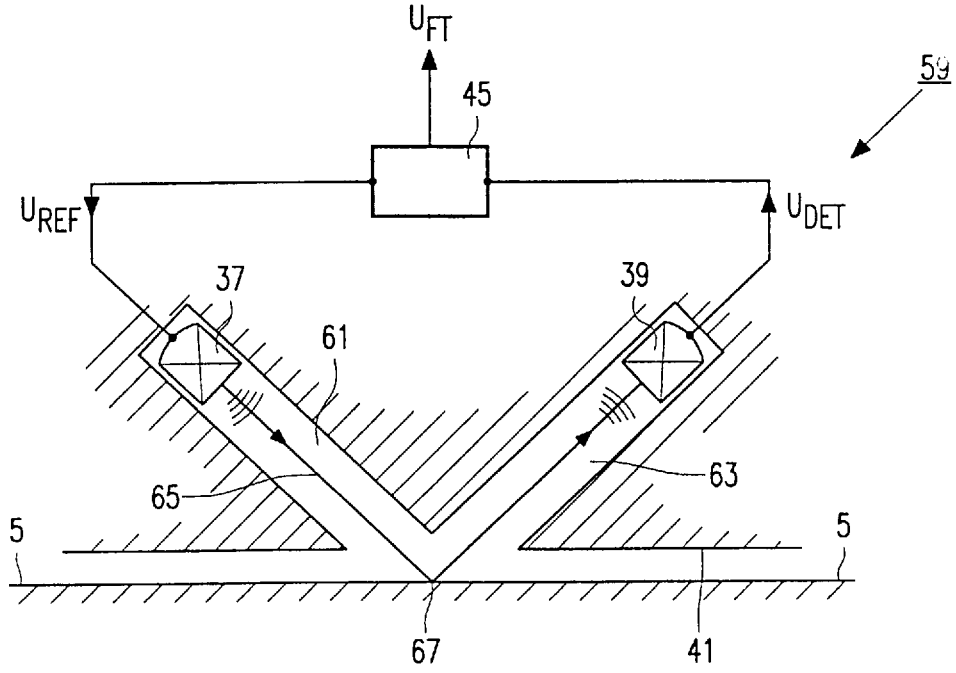

In the third embodiment of a surface type detector 59 for use in the suction attachment 9 according to the invention, shown diagrammatically in FIG. 5, the vibration generator 37 and the vibration detector 39 are each accommodated in a separate, channel-type cavity 61, 63 in the lower side 41 of the suction nozzle 11. The air vibrations 65 generated by the vibration generator 37 during operation are substantially entirely directed at a comparatively small portion 67 of the surface 5 to be cleaned and from said portion 67 substantially fully reflected to the vibration detector 39 because of the use of the channel-type cavities 61, 63. Undesirable scattering of the generated air vibrations 65 is prevented as much as possible thereby. Such scattering of the generated air vibrations 65 could lead, for example, to a direct crosstalk from the vibration generator 37 to the vibration detector 39, which could seriously detract from the reliability of the surface type detector 59.

Figure 6:
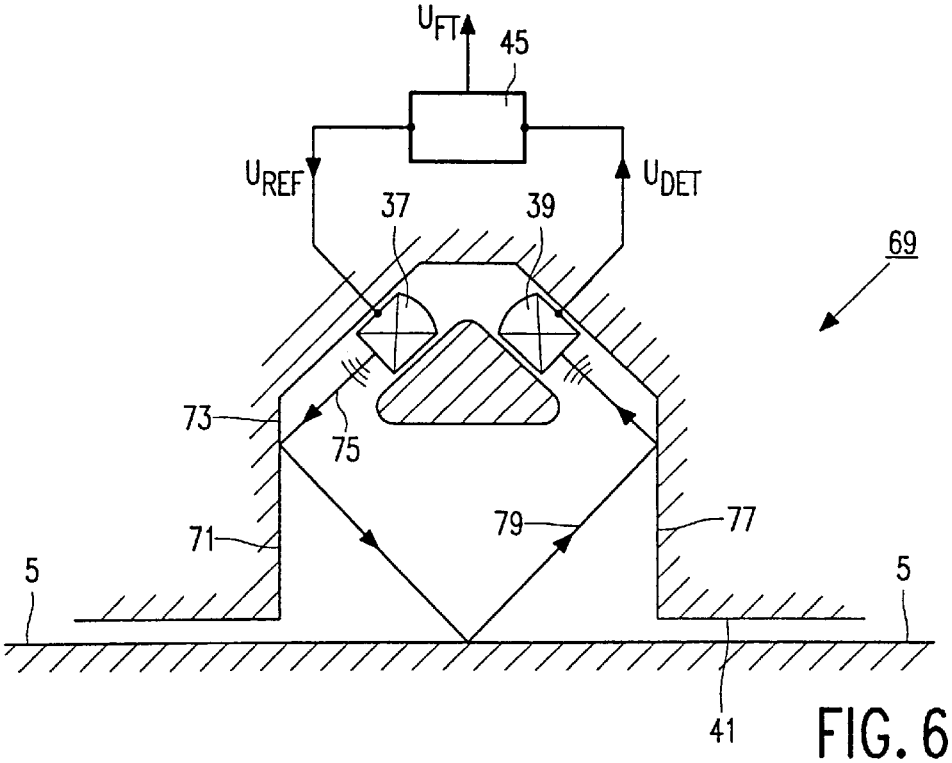

In the fourth embodiment of a surface type detector 69 for use in the suction attachment 9 according to the invention, shown diagrammatically in FIG. 6, the vibration generator 37 and the vibration detector 39 face away from one another and are, as in the surface type detector 51 described above, arranged in a depression 71 provided in the lower side 41 of the suction nozzle 11. A first side wall 73 of the depression 71 present adjacent the vibration generator 37 forms a first reflector of the surface type detector 69 by means of which the air vibrations 75 generated by the vibration generator 37 during operation are reflected to the surface 5 to be cleaned. Furthermore, a second side wall 77 of the depression 71 situated adjacent the vibration detector 39 forms a second reflector of the surface type detector 69 by means of which the air vibrations 79 reflected by the surface 5 to be cleaned are reflected towards the vibration detector 39. The use of said reflectors provides a high degree of freedom as regards the mutual positioning of the vibration generator 37 and the vibration detector 39. In the surface type detector 69 shown in FIG. 6, this freedom has been utilized for positioning the vibration generator 37 and the vibration detector 39 immediately next to one another.

Figure 7:
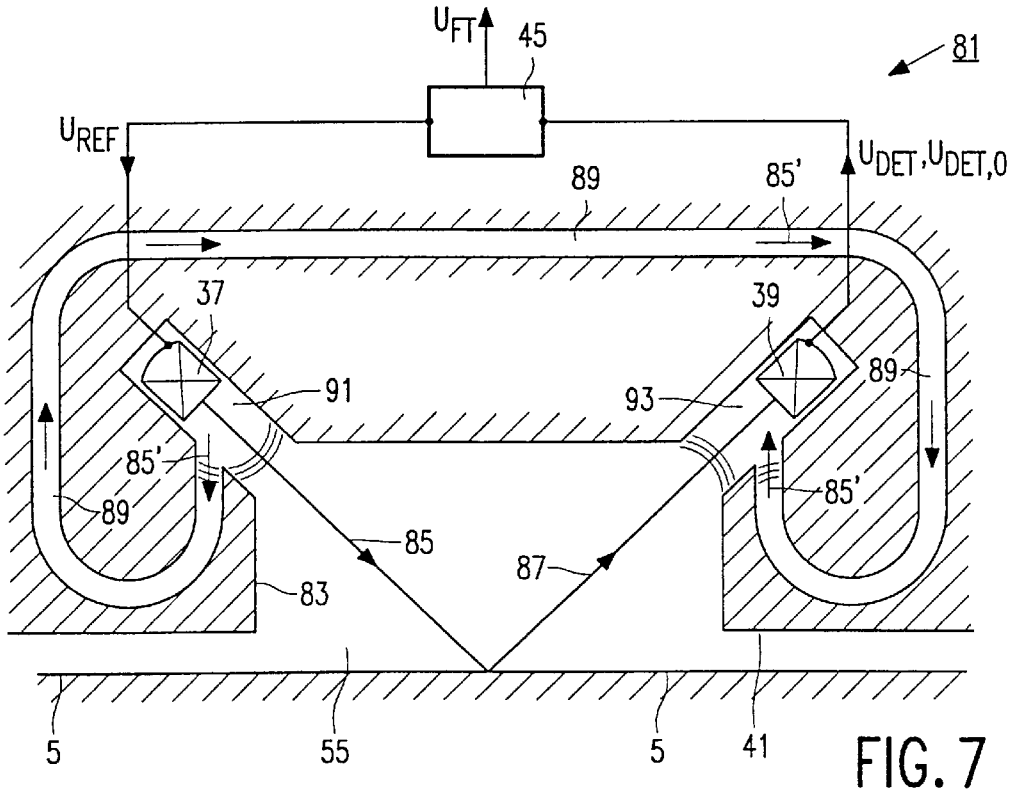

In the fifth embodiment of a surface type detector 81 for use in the suction attachment 9 according to the invention, shown diagrammatically in FIG. 7, the vibration generator 37 and the vibration detector 39 are, as in the surface type detectors 51 and 69 discussed above, arranged in a depression 83 which is provided in the lower side 41 of the suction nozzle 11. The vibration generator 37 of the surface type detector 81 generates the air vibration 85 intermittently during operation, i.e. it generates the air vibrations 85 during short periods each time with regular intervals. Said period is so short that substantially no interference can arise between the generated air vibrations 85 and the reflected air vibrations 87 in the depression 83 and the detection space 55.

Since the generated air vibrations 85 are not exclusively directed from the vibration generator 37 directly to the surface 5 to be cleaned and from the surface 5 to be cleaned directly to the vibration detector 39 during operation, but are indeed scattered partly in other directions, interferences between the generated air vibrations 85 and the reflected air vibrations 87 would arise in the depression 83 and the detection space 55 if the vibration generator 37 were to generate the air vibrations 85 without interruptions. Such interferences have a pattern which changes comparatively strongly with comparatively small changes in the acoustic properties of the detection space 55 which arise, for example, because of pollution of the detection space 55 or because of fluctuations in the distance between the surface 5 to be cleaned and the vibration generator 37 and vibration detector 39. In addition, comparatively great differences arise in the amplitudes of the air vibrations within said pattern. Such interferences would thus adversely affect the accuracy and the reliability of the surface type detector 81. Since the vibration generator 37 of the surface type detector 81 generates the air vibrations 85 during only a comparatively short period each time, the directly generated air vibrations 85 have already disappeared each time before the reflected air vibrations 87 can interfere with the directly generated air vibrations 85. The reliability and the accuracy of the surface type detector 81 are considerably improved because said detrimental interferences between the generated air vibrations 85 and the reflected air vibrations 87 are thus substantially prevented. As FIG. 7 shows, the surface type detector 81 is further provided with a parallel circuit 89 which connects a cavity 91, in which the vibration generator 37 is accommodated, with a cavity 93, in which the vibration detector 39 is accommodated. A portion 85' of the air vibrations generated by the vibration generator 37 is directly conducted, i.e. not via the surface 5 to be cleaned, from the vibration generator 37 to the vibration detector 39 through the parallel circuit 89 during operation. The piezoelectric vibration generator 37 and the piezoelectric vibration detector 39 are sufficiently robust and substantially insensitive to pollution under normal operating conditions. The properties of the piezoelectric vibration generator 37 and the piezoelectric vibration detector 39, however, may change due to aging of the piezoelectric material and due to temperature fluctuations. Both the amplitude of the reflected air vibrations 87 (output signal UDET) and the original amplitude of the generated air vibrations 85' (output signal $u_{DET,0}$) are measurable by means of the vibration detector 39 thanks to the use of the parallel circuit 89. The parallel circuit 89 for this purpose has a length such that the original, intermittently generated air vibrations 85' and the reflected air vibrations 87 always reach the vibration detector 39 at different moments. The control member 45 determines a ratio between the output signals $u_{DET}$ and $u_{DET,0}$ and compares the ratio thus determined with experimentally ascertained ratios between the amplitude of the reflected air vibrations and the original amplitude of the generated air vibrations, which ratios are stored in the control member 45 for a number of different types of surface 5 to be cleaned. Since said ratio is substantially independent of the temperature and of any ageing of the vibration generator 37 and the vibration detector 39, the reliability of the surface type detector 81 is thus further enhanced through the use of the parallel circuit 89.

Figure 8:
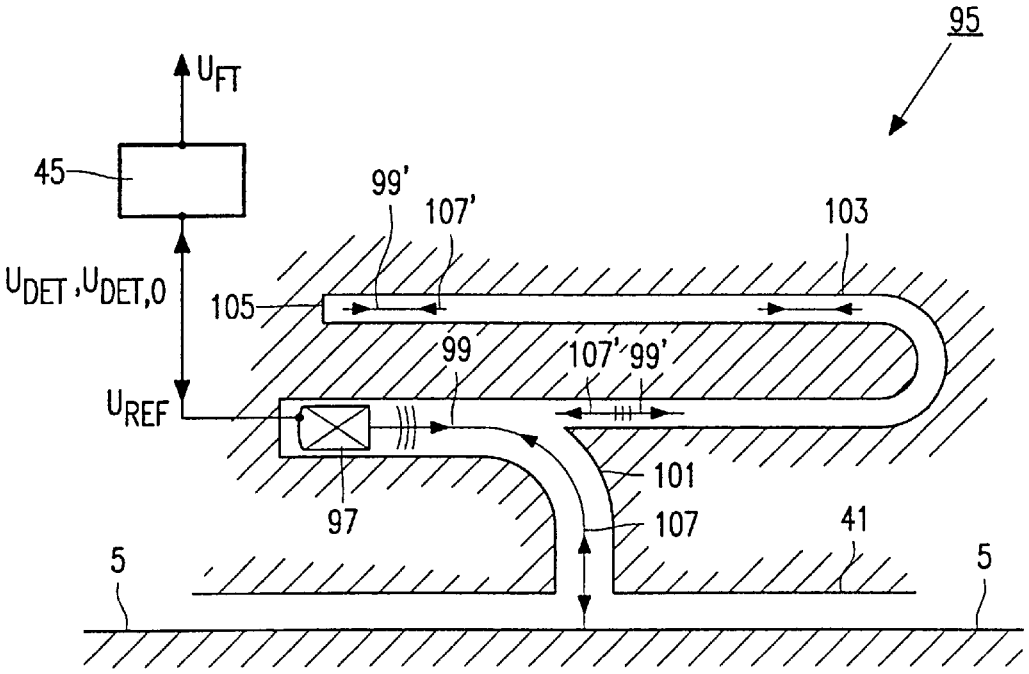

The sixth embodiment of a surface type detector 95 for use in the suction attachment 9 according to the invention, shown diagrammatically in FIG. 8, is provided with a piezoelectric vibration generator 97 which is usual and known per se and which can be switched over so as to form a vibration detector. Since the vibration generator 97 thus at the same time comprises the vibration detector, the number of components of the surface type detector 95 is considerably reduced and the construction of the surface type detector 95 is considerably simplified. The vibration generator 97 generates the air vibrations 99 intermittently during operation, as did the vibration generator 37 of the surface type detector 81 discussed above. The air vibrations 99 generated during a short period are conducted through a main channel 101 to the surface 5 to be cleaned each time, reflected by the surface 5 to be cleaned, and guided back through the main channel 101 to the vibration generator 97 which has in the mean time been switched over to form a vibration detector. The surface type detector 95 is provided with a parallel circuit 103, as was the surface type detector 81 discussed above. As FIG. 8 diagrammatically shows, the parallel circuit 103 forms a dead end and is provided with an end reflector 105 adjacent this end. During operation, a portion 99' of the air vibrations generated by the vibration generator 97 during a short period is guided into the parallel circuit 103 and reflected back by the end reflector 105 of the parallel circuit 103 to the vibration generator 97 which has in the mean time been switched over so as to form a vibration detector. The parallel circuit 103 has a length such that the air vibrations 107' reflected by the end reflector 105 and the air vibrations 107 reflected by the surface 5 to be cleaned reach the vibration generator 97 at different moments, so that the vibration generator 97, like the vibration detector 39 of the surface type detector 81 discussed above, is capable of measuring a ratio between the amplitude of the air vibrations 107 reflected by the surface 5 to be cleaned and an original amplitude of the air vibrations 99' generated by the vibration generator 97.

It is noted that the invention relates not only to vacuum cleaners, but also to electrical surface treatment devices of different kinds which are provided with surface type detectors for detecting a type of a surface to be treated. Examples of this which may be mentioned are electrical polishing machines, electrical floor mops, electrical steam cleaners, and electrical shampooing devices. In such electrical surface treatment devices according to the invention, the output signal of the surface type detector is delivered, for example, to an electric control member by means of which the operation of the surface treatment device is controlled. In an electrical polishing device, for example, a speed of rotation of a polishing brush of the polishing device may thus be controlled as a function of the output signal of the surface type detector, while in an electric steam cleaner and an electric shampooing device, for example, the quantity of steam and the quantity of shampoo, respectively, to be supplied may be controlled as a function of the output signal of the surface type detector.

The vacuum cleaners described above are floor-type vacuum cleaners. It is noted that the invention also covers so-called upright vacuum cleaners wherein a suction nozzle is coupled to a handle via a tube, while a housing with a suction unit accommodated therein is fastened to said tube. The invention also relates, for example, to central vacuum cleaning installations where one or several suction attachements can be connected to a number of suction connection points of a fixed system of suction lines incorporated in a building.

It is further noted that, instead of the amplitude described above, also a different physical quantity of the air vibrations reflected by the surface to be treated may be measured by means of the vibration detector according to the invention.

It is thus possible, for example, for the vibration detector to measure a frequency spectrum of the air vibrations reflected by the surface to be treated. Another example which may be mentioned is a vibration speed of the vibrating air particles.

It is further noted that, according to the invention, the surface type detector may also be arranged in a location other than in the suction nozzle 11. Thus, for example, the surface type detector may also be provided in the housing 1, the vibration generator 37 and the vibration detector 39 being positioned in a lower side of the housing 1.

It is further noted that the invention also relates to electrical surface treatment devices where the surface type detector used therein does not comprise a separate vibration generator. In such an alternative embodiment, the vibration detector of the surface type detector measures, for example, the amplitude of air vibrations reflected by the surface to be treated, which air vibrations originate from other acoustic sources of the electrical surface treatment device such as, for example, from the suction unit of a vacuum cleaner. Since such air vibrations often have a reasonably constant amplitude under normal operating conditions, a reasonably reliable measurement of the type of surface to be cleaned is obtained in such an alternative embodiment.

It is finally noted that another type of vibration generator and another type of vibration detector may be used instead of the piezoelectric vibration generator 37, 97 and the piezoelectric vibration detector 39 mentioned above, such as, for example, an electrodynamic vibration generator and an electrodynamic vibration detector, which are usual and known per se.

What is claimed is:

1. An electrical surface treatment device provided with a surface type detector for detecting a type of surface to be treated, which surface type detector comprises a vibration detector which detects air vibrations reflected by the surface to be treated and delivers an output signal characteristic of the type of the surface to be treated during operation, wherein the output signal is determined by a value of a physical quantity of the air vibrations reflected by the surface to be treated, which value is measurable by means of the vibration detector.

2. An electrical surface treatment device as claimed in claim 1, wherein the physical quantity is an amplitude, while the surface type detector comprises a vibration generator for generating air vibrations having a predetermined amplitude.

3. An electrical surface treatment device as claimed in claim 2, wherein the vibration generator generates air vibrations with a frequency of at least 15,000 Hz during operation.

4. An electrical surface treatment device as claimed in claim 2, wherein the vibration generator generates air vibrations having a frequency which varies within a predetermined range during operation.

5. An electrical surface treatment device as claimed in claim 2, wherein the vibration generator comprises a piezoelectric vibration generator.

6. An electrical surface treatment device as claimed in claim 2, wherein the vibration generator generates the air vibrations intermittently during operation.

7. An electrical surface treatment device as claimed in claim 1, wherein the vibration detector comprises a piezoelectric vibration detector.

8. An attachment suitable for use in an electrical surface treatment device as claimed in claim 1, which attachment comprises a suction nozzle, wherein the surface type detector is accommodated in the suction nozzle of the attachment.

9. An electrical surface treatment device provided with a surface type detector which detects a type of surface to be treated, which surface type detector comprises (a) a vibration detector which detects air vibrations reflected by the surface to be treated and delivers an output signal characteristic of the type of the surface to be treated during operation and (b) a vibration generator which generates air vibrations having a predetermined amplitude, wherein the output signal is determined by a value of an amplitude of the air vibrations reflected by the surface to be treated, which value is measurable by means of the vibration detector, and wherein the vibration generator comprises the vibration detector, such that the vibration generator can be switched over to form the vibration detector.

10. An electrical surface treatment device as claimed in claim 7, wherein the parallel circuit has a dead end and is provided near this end with an end reflector for reflecting back the air vibrations conducted into the parallel circuit.

11. An electrical surface treatment device provided with a surface type detector which detects a type of surface to be treated, which surface type detector comprises (a) a vibration detector which detects air vibrations reflected by the surface to be treated and delivers an output signal characteristic of the type of the surface to be treated during operation and (b) a vibration generator which generates air vibrations having a predetermined amplitude, wherein the output signal is determined by a value of an amplitude of the air vibrations reflected by the surface to be treated, which value is measurable by means of the vibration detector, and wherein the vibration generator and the vibration detector face one another at an angle of approximately 90°.

12. An electrical surface treatment device provided with a surface type detector which detects a type of surface to be treated, which surface type detector comprises (a) a vibration detector which detects air vibrations reflected by the surface to be treated and delivers an output signal characteristic of the type of the surface to be treated during operation and (b) a vibration generator which generates air vibrations having a predetermined amplitude, wherein the output signal is determined by a value of an amplitude of the air vibrations reflected by the surface to be treated, which value is measurable by means of the vibration detector, and wherein the surface type detector is provided with a first reflector for reflecting the air vibrations generated by the vibration generator towards the surface to be treated and with a second reflector for reflecting the air vibrations reflected by the surface to be treated towards the vibration detector.

13. An electrical surface treatment device provided with a surface type detector which detects a type of surface to be treated, which surface type detector comprises (a) a vibration detector which detects air vibrations reflected by the surface to be treated and delivers an output signal characteristic of the type of the surface to be treated during operation and (b) a vibration generator which generates air vibrations having a predetermined amplitude, wherein the output signal is determined by a value of an amplitude of the air vibrations reflected by the surface to be treated, which value is measurable by means of the vibration detector, and wherein the vibration generator generates the air vibrations intermittently during operation, and the surface type detector comprises a parallel circuit through which part of the air vibrations generated by the vibration generator can be conducted directly to the vibration detector.

14. An attachment suitable for use in an electrical surface treatment device provided with a surface type detector which detects a type of surface to be treated, which surface type detector comprises (a) a vibration detector which detects air vibrations reflected by the surface to be treated and delivers an output signal characteristic of the type of the surface to be treated during operation and (b) a vibration generator which generates air vibrations having a predetermined amplitude, wherein the output signal is determined by a value of an amplitude of the air vibrations reflected by the surface to be treated, which value is measurable by means of the vibration detector, which attachment comprises a suction nozzle having the surface type detector accommodated therein, and wherein the vibration generator and the vibration detector of the surface type detector are positioned in a detection space which during operation is bounded by the surface to be treated and a lower side of the suction nozzle.

15. An attachment as claimed in claim 14, wherein the vibration generator and the vibration detector are positioned in a depression provided in the lower side of the suction nozzle.

16. An attachment as claimed in claim 14, wherein the vibration generator and the vibration detector are each accommodated in a separate channel-type cavity provided in the lower side of the suction nozzle.

* * * * *